US005632642A

United States Patent [19]

Briski

[11] Patent Number: 5,632,642

[45] Date of Patent: May 27, 1997

[54] PRE-SET LOCK SYSTEM

[75] Inventor: Curt M. Briski, Westland, Mich.

[73] Assignee: Yazaki Corporation, Tokyo, Japan

[21] Appl. No.: 546,905

[22] Filed: Oct. 23, 1995

[51] Int. Cl.[6] ..... H01R 13/627

[52] U.S. Cl. ..... 439/364

[58] Field of Search ..... 439/359, 360, 439/361, 362, 363, 364, 357, 358

[56] References Cited

U.S. PATENT DOCUMENTS

| | | | |
|---|---|---|---|
| 4,627,759 | 12/1986 | Kato et al. | 403/2 |
| 4,804,341 | 2/1989 | Kato et al. | 439/733 |
| 4,957,449 | 9/1990 | Hatagishi | 439/364 |
| 5,271,689 | 12/1993 | Ishii et al. | 403/408.1 |
| 5,376,016 | 12/1994 | Inaba et al. | 439/357 |

*Primary Examiner*—Neil Abrams
*Assistant Examiner*—Yong Kim
*Attorney, Agent, or Firm*—Young & Basile, P.C.

[57] ABSTRACT

A pre-set lock system for a bolt-type electrical connector unit is disclosed which comprises a rotatable bolt having a bolt shaft, and first and second connector members seated in axially-opposing fashion along the longitudinal axis of the bolt shaft. At least the first connector member includes means for engaging the bolt shaft and moving relative to the longitudinal axis thereof between a first pre-set condition and a second assembled condition. The first connector member and the bolt shaft further include complementally engaging elements by which the bolt shaft and the first connector member are engaged in the first pre-set condition.

17 Claims, 3 Drawing Sheets

PRE-SET LOCK SYSTEM

FIELD OF THE INVENTION

The present invention relates in general to bolt-type connector units and more particularly to a pre-set lock system for such units wherein the pre-set features of the lock system are disposed on each of the bolt shaft and one of a pair of connector members, such that the simplicity of the connector unit is increased while the overall size of the individual connector members is reduced.

BACKGROUND OF THE INVENTION

In bolt-type connector units, for example bulkhead-mounted electrical connectors employed in automobile engine compartments, it is known to include pre-set locking features on each of the individual connector members in order to ensure that the entire connector unit—comprising the bolt and the connector members—is maintained in a fixed position prior to tightening of the bolt. This provides both a positive indication that the separate connector members are ready to be assembled, while preventing improper alignment or cross-threading of the bolt.

FIG. 1 depicts such a typical prior art bolt-type connector unit, which includes axially mateable male 10 and female 20 halves seated along the shaft 31 of a bolt 30. First mateable half 10 is threadingly engaged to bolt shaft 31 and is coaxially moveable relative to the longitudinal assembled condition wherein bolt 30 is fully tightened and the two halves 10 and 20 are axially mated. A sleeve 21 is provided around bolt shaft 31 in female half 20, which sleeve matingly receives therein a correspondingly shaped projection 11 provided on male half 10.

On male half 10, the pre-set locking features in this type of connector unit comprise two longitudinal channels 15 recessed within opposite surfaces of projection 11. Correspondingly, female half 20 includes detents 25, each on opposite interior surfaces of sleeve 21 and arranged in alignment with channel 15. Each longitudinal channel 15 includes a transversely oriented locking tab 16 therein; locking tabs 16 arranged more proximate forward face 12 of portion 11 such that each detent is forced into a locking tab 16 as the male and female halves are mated. From this pre-set condition, bolt 30 may be tightened within male half 10 to bring both halves together into a confronting, fully assembled condition.

The disadvantage to this arrangement is that the described pre-set locking features are incorporated into each of the mateable halves; locking tabs 16 and channels 15 disposed on portion 11 of the male half so as to project outwardly from the axis of bolt shaft 31 in order to receive the inwardly projecting detents disposed on sleeve 21 of female half 20. Consequently, the radial dimensions R of both halves must be increased to accommodate these pre-set features, thereby precluding use of the assembled connector unit in applications where space is limited.

SUMMARY OF THE INVENTION

Accordingly, it is an object of the present invention to provide a pre-set lock system for a bolt-type connecter unit wherein the overall radial dimensions of the connector members are minimized.

This and other objects of the present invention are achieved through a bolt-type connector unit comprising axially-opposing first and second connector members seated along the longitudinal axis of a bolt shaft. The first connector member includes means for engaging the bolt shaft in order to move relative to the longitudinal axis thereof between a first pre-set condition and a second assembled condition wherein the first and second connector members are confronting. The first connector member and the bolt shaft further include complementary engaging elements by which the bolt shaft and the first connector member are engaged in the pre-set condition. Because these pre-set features are disposed on each of the bolt shaft and the first connector member, respectively, the overall radial dimensions of the assembled connector unit are reduced over the radial dimensions of a typical prior art bolt-type connector.

The complementally engaging elements of the present invention comprise a notch defined on the bolt shaft, and one or more corresponding detents projecting inwardly from the first connector member in such a manner as to retain the bolt shaft in the described pre-set condition. Also according to this invention, the notch may be circumferential.

According to another feature of this invention, the bolt includes both an annular ridge and an annular enlarged portion disposed on the bolt shaft in spaced-apart fashion. The ridge and the enlarged portion further define the notch.

The first and second connecter members of the present invention comprise, respectively, axially mating first male and second female connector members. Accordingly, the first male connector member further includes a centrally disposed protrusion. A passageway opens onto the centrally disposed protrusion for axially receiving the bolt shaft. The detents are disposed on this centrally disposed protrusion so as to be adjacent the passageway opening.

According to still another feature of this invention, the centrally disposed protrusion is further defined by a pair of flexible, finger-like projections arranged in diametrically-opposed fashion about the opening. The detents extend from the distal ends of these projections so as to engage the complementary notch defined on the bolt shaft.

DETAILED DESCRIPTION OF THE DRAWINGS

Figure 1:
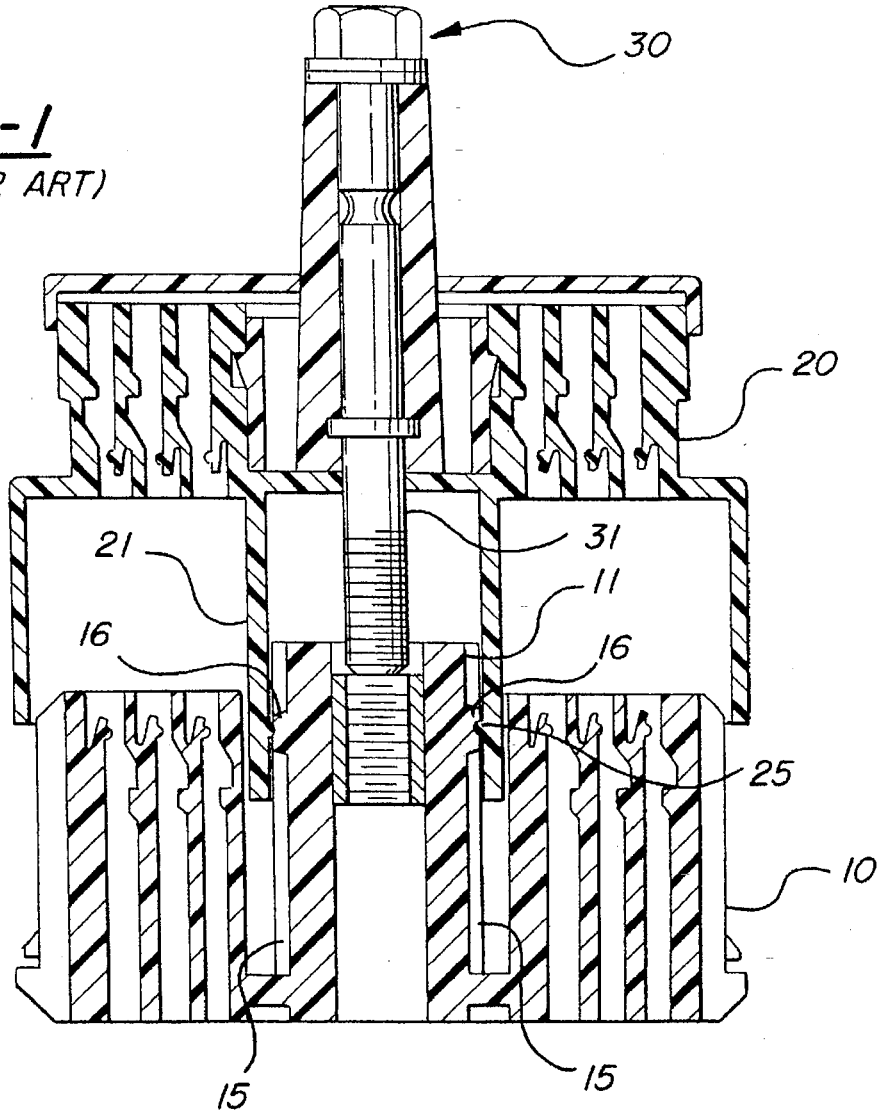
FIG-1 (PRIOR ART)
FIG. 1 is a longitudinal cross-section of a prior art bolt-type connector shown in a pre-set condition.

Referring now to the drawings, a pre-set lock system is depicted for use in bolt-type connector units. While the illustrated embodiment depicts an electrical connector, such as is commonly employed in automobiles, it will be understood that bolt-type connector units have a myriad of known applications and that the present invention may be equally well adapted to them all.

Figure 4:
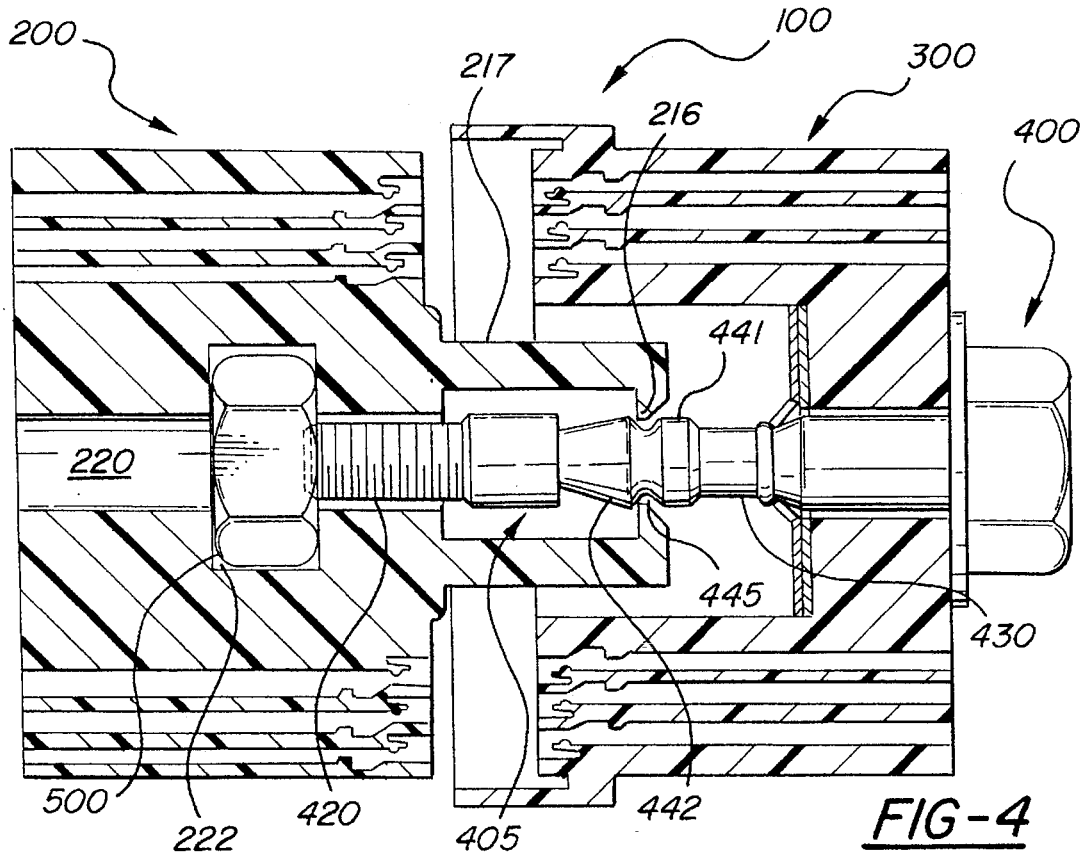
FIG. 4 is a longitudinal cross-section of the connector members according to the present invention in a pre-set condition.
Figure 5:
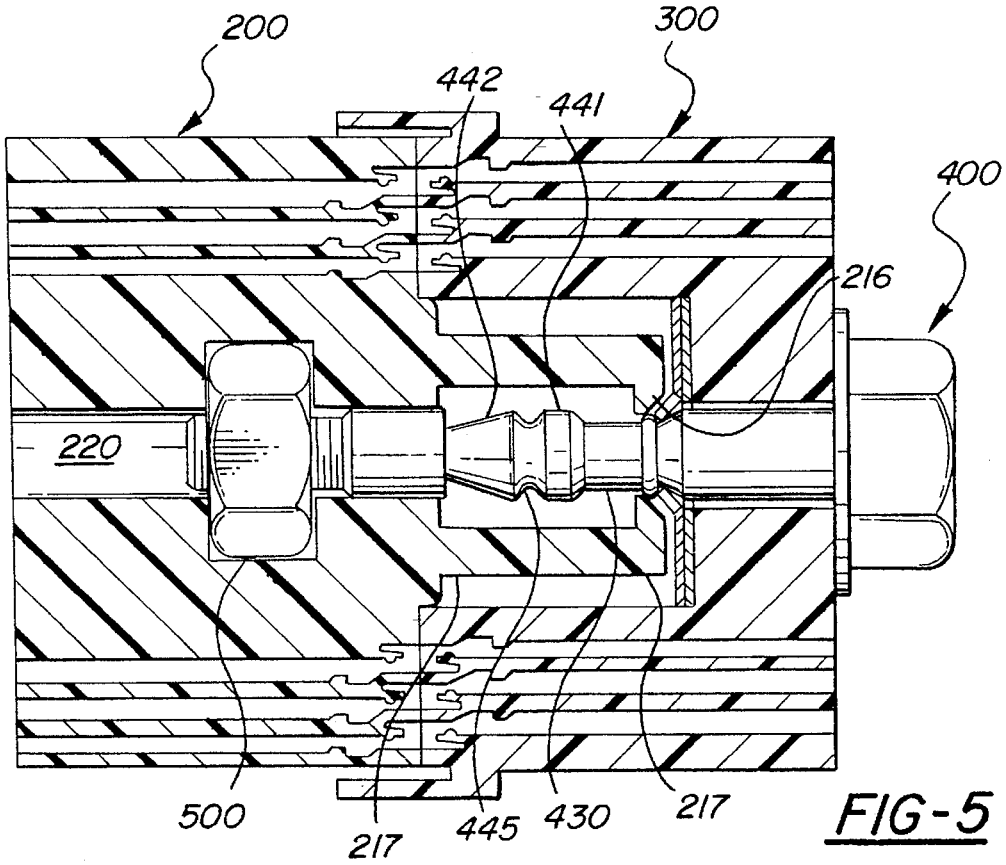
FIG. 5 is a longitudinal cross-section view of the connector members according to the present invention shown in a fully assembled confronting condition.

Referring first to FIGS. 4 and 5, the pre-set lock system of the present invention is incorporated in a bolt-type connector unit 100 generally comprising first 200 and second 300 connector members seated, as shown, in axially-opposing fashion along the longitudinal axis of shaft 405 of bolt 400. First connector member 200 includes means, such as the illustrated nut 500, for both engaging bolt 400 as moving relative thereto between a first pre-set condition (FIG. 4) and a second assembled condition wherein the bolt is fully tightened with respect to the means provided in the first connector and the two connector members are confronting (FIG. 5).

As indicated, these means comprise a threaded nut 500 securely disposed within a radially-enlarged chamber 222 defined in passageway 220. Nut 500 threadingly receives the correspondingly threaded region 410 of bolt shaft 405 to drive first connector member 200 axially therealong in a direction either towards or away from second connector member 300, depending upon the direction of rotation of the bolt shaft. Of course, it is similarly conceivable that passageway 220 simply be integrally threaded.

The connector members of the present invention are manufactured from any suitable material such as metal, plastic, or the like, depending on both user preference and the selected function of the connector unit 100. As depicted, both first 200 and second 300 connector members define generally box-shaped, axially-mateable elements, first connector member 200 comprising the male element and second connector 300 defining the female element. However, while such mateable connectors do provide greater rigidity and a corresponding resistance to shearing forces, the first and second connector members need not define such mateably confronting elements. Instead, by way of example, the present invention serves equally well to reduce the radial dimensions of connector members which, in the assembled confronting condition, define simply abutting planar surfaces.

Figure 2B:
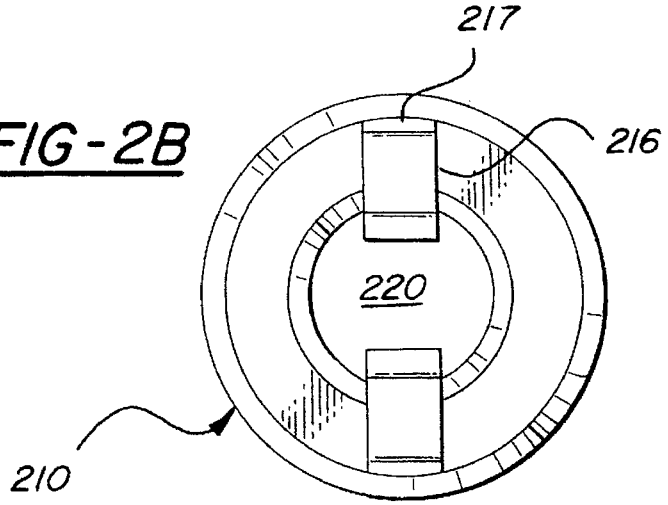
FIG. 2B is a frontal elevation of one embodiment of an engaging element of the present invention.
Figure 2A:
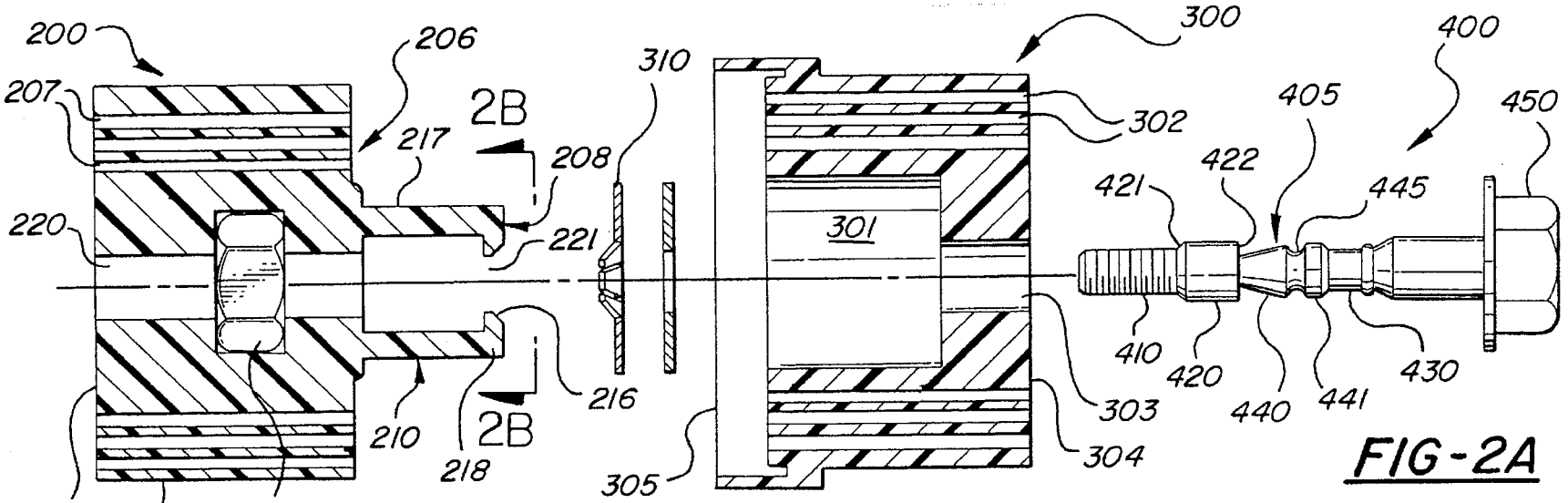
FIG. 2A is an exploded cross-section of the bolt-type connector unit according to the present invention.

Referring next to FIGS. 2A and 2B, first connector member 200 is characterized by a main body 205 from the inward surface 206 of which projects a centrally-disposed protrusion 210. In the form of the illustrated electrical connector unit, at least main body 205 further includes therethrough a plurality of parallel, longitudinally disposed terminal passages 207 for receiving corresponding electrical contacts and their associated leads (not shown). A substantially cylindrical passageway 220 extends longitudinally through protrusion 210 for coaxially receiving therein a rotatable bolt shaft 405. As shown, passageway 220 opens onto both front 208 and rear 209 surfaces of connector member 200. However, the passageway may also end abruptly, leaving rear surface 209 continuous. In this regard, one of skill in the art will appreciate that the length of passageway 220 will depend on the length of bolt shaft 405 in relation to the length of connector member 200 and will thus be dictated thereby.

The pre-set locking features of first connector member 200 include, as shown, elements comprising a pair of detents 216 projecting transversely inward towards the longitudinal axis of the first connector member. Each detent is integral to distal end 218 of one of a pair of flexibly resistant, finger-like projections 217 (FIG. 2B). Projections 217 extend longitudinally from and define a portion of the axial length of protrusion 210 and are predisposed in unflexed, parallel opposing fashion about opening 221 to passageway 220 at front surface 208.

Figure 3:
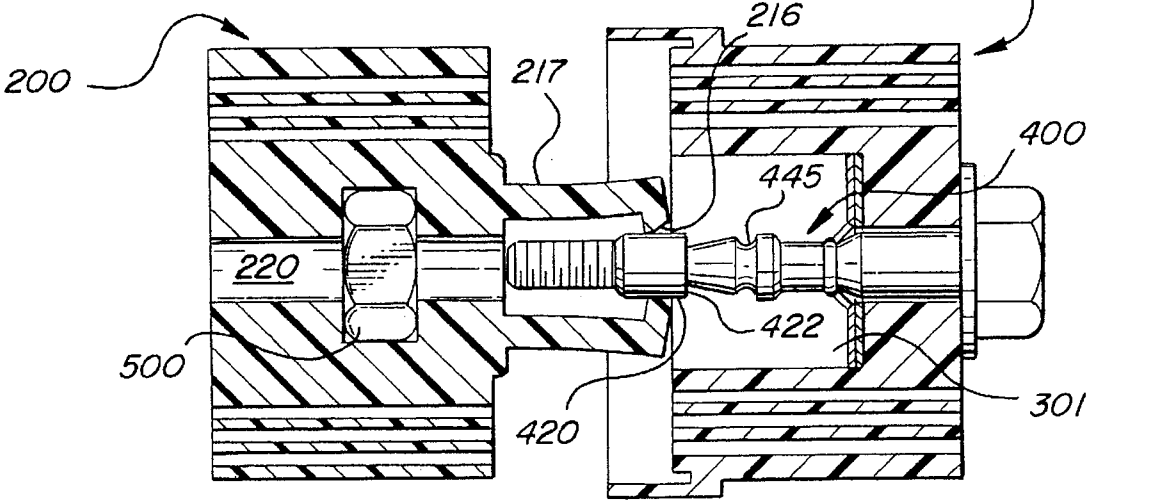
FIG. 3 is a longitudinal cross-section of the bolt-type connector unit of the present invention in a condition of initial assembly.

Second connector member 300 comprises a female-type connector axially mateable to the first connector by means of an interior space 301 defined therein, which space opens at front surface 305 to define an area corresponding generally to the axial and radial dimensions of protrusion 210 (including projections 217) of first connector member 200. A plurality of parallel, longitudinally extending terminal passages 302 are provided through second connector member 300, each passage axially aligned with a passage 207 on the first connector member so as to define a plurality of unified terminal passages when the male and female halves are mateably confronting. A passageway 303 for coaxially receiving a portion of bolt shaft 405 is disposed between interior space 301 and a rear-most surface 304. As shown in FIG. 3, a pair of washers, including lock-washer 310 may also be included to prevent withdrawal of bolt 400 through passageway 303.

Still referring to FIG. 2A, bolt 400 is preferably manufactured from metal and consists of a head 450 and shaft 405 portions. Shaft 405 is characterized by a longitudinal cross-section defining irregular lateral surface contours including: a threaded region 310 proximate the end of shaft 405; an arresting region 420 including at opposite ends thereof a frustoconically shaped annular stop-shoulder 421 adjacent threaded region 410 in the upstream direction and an annular rim 422 perpendicularly oriented with respect to the longitudinal axis of bolt shaft 405; and an upper region 430 disposed between arresting region 420 and bolt head 450. Further provided between arresting region 420 and upper region 430 is an engaging element complementary in shape and size to each of detents 216 which, in the illustrated form, comprises a circumferential notch 445. Notch 445 is in turn both disposed between and defined by first 441 and second 440 annular ridges of shaft 405. Second annular ridge 440 flares radially outward towards notch 445 such that detents 216 may not be brought into pre-set engagement with notch 445 without the application of sufficient external pressure to first connector member 200.

Turning again to FIGS. 3, 4, and 5, operation of this invention will be better understood. As first 200 and second 300 connector members are brought into initial mating engagement (FIG. 3), bolt shaft 405 enters passageway 220. As they encounter the outwardly sloping surface of annular stop-shoulder 421, detents 216 are forced radially outward, consequently urging projections 217 away from their predisposed, relaxed positions. Detents 216 confront and subsequently pass over arresting region 420 and rim 422 as connector members 200 and 300 are forced together; projections 217 being ultimately returned to their relaxed positions as detents 216 move into complimentary engagement with notch 445 to define the pre-set lock condition (FIG. 4). Because rim 422 is perpendicularly oriented with respect to the longitudinal axis of bolt 400, it will be appreciated that separation of the first and second connector members at this point is greatly impaired. Conversely, first annular ridge 441 presents an upstream obstacle which frustrates further assembly of connector members 200 and 300 prior to tightening of bolt 400.

From this pre-set condition, separate connector members 200 and 300 may then be brought into the confronting, assembled condition by rotatably tightening bolt 400 into nut 500 (FIG. 5). First connector member 200 is thereby urged along bolt shaft 405, again flexing projections 217 away from their relaxed positions as detents 216 are forced over first annular ridge 441; projections 217 subsequently moving radially inward to their relaxed, predisposed positions as detents 216 encounter the narrower diameter of upper region 430.

Of course, it will be understood by those of ordinary skill in the art that the foregoing specification is merely illustrative of one embodiment of the present invention, and that many additions and modifications thereto are possible without department from the spirit and broader aspects thereof as defined in the appended claims.

The invention in which an exclusive property or privilege is claimed is defined as follows:

1. A pre-set lock system comprising a rotatable bolt having a bolt shaft, and at least first and second connector members seated in axially-opposing fashion along the longitudinal axis of said bolt shaft, said first connector member including means for threadedly engaging said bolt shaft and moving relative to said longitudinal axis between a first pre-set condition and a second assembled condition, said first connector and said bolt shaft further including complementally engaging elements by which said bolt shaft and said first connector member are engaged in said first pre-set condition.

2. The pre-set lock system of claim 1, wherein said complementally engaging elements comprise a notch defined on said bolt shaft and one or more detents projecting from said first connector member inwardly towards said bolt shaft.

3. The pre-set lock system of claim 2, wherein said notch is circumferential.

4. The pre-set lock system of claim 3, wherein said bolt includes first and second annular ridges disposed on said shaft in spaced-apart fashion, said annular ridges defining said notch therebetween.

5. The pre-set lock system of claim 4, wherein said at least first and second connector members comprise, respectively, axially mating first male and second female connector members, said first male connector member including a centrally disposed protrusion, and a passageway in said centrally disposed protrusion for axially receiving said bolt shaft, wherein said detents are arranged on said centrally disposed protrusion so as to be adjacent said passageway.

6. The pre-set lock system of claim 5, wherein said centrally disposed protrusion is further defined by a pair of flexible finger-like projections arranged in diametrically-opposed fashion about said opening, said detents extending from the distal ends of said projections.

7. In an electrical connector including a rotatable bolt having a bolt shaft, and axially mating first and second connector members seated in axially-opposing fashion along the longitudinal axis of said bolt shaft, said first connector member further including means for threadingly engaging said bolt shaft and moving relative to said longitudinal axis thereof between a first pre-set condition and a second assembled condition, the improvement comprising:

a pre-set lock system whereby said first and second connector members are at least transitionally retained in said pre-set condition, said pre-set lock system comprising complementary engaging elements disposed on said first connector member and said bolt shaft, whereby said first connector member and said bolt shaft are engaged in said first pre-set condition.

8. The pre-set lock system of claim 7, wherein said complementary engaging elements comprise a notch defined on said bolt shaft and one or more detents projecting from said first connector member inwardly towards a bolt shaft.

9. The pre-set lock system of claim 8, wherein said notch is circumferential.

10. The pre-set lock system of claim 9, wherein said bolt includes first and second annular ridges disposed on said shaft in spaced-apart fashion, said annular ridges defining said notch therebetween.

11. The pre-set lock system of claim 10, said first connector member including a centrally disposed protrusion having a passageway for axially receiving said bolt shaft, wherein said detents being disposed on said centrally disposed protrusion so as to be adjacent said passageway.

12. The pre-set lock system of claim 11, wherein said centrally disposed protrusion is further defined by a pair of flexible finger-like projections arranged in diametrically-opposed fashion about said opening, said detents extending from distal ends of said projections.

13. In an electrical connector, including a rotatable bolt having a bolt shaft, and axially mating first and second connector members seated in axially-opposing fashion along the longitudinal axis of said bolt shaft, said first connector member including means for threadingly engaging said bolt shaft and moving relative to said longitudinal axis thereof between a first pre-set condition and a second assembled condition wherein said first and second connector members are mated, the improvement comprising:

a pre-set lock system whereby said first and second connector members are at least transitionally retained in said pre-set condition, said pre-set lock system comprising complementally engaging elements disposed on said first connector member and said bolt shaft, said engaging elements comprising a notch disposed on said bolt shaft and one or more detents disposed on said first connector member, said detents projecting inwardly from said first connector member towards said bolt shaft.

14. The pre-set lock system of claim 13, wherein said notch is circumferential.

15. The pre-set lock system of claim 14, wherein said bolt includes first and second annular ridges disposed on said shaft in spaced-apart fashion, said annular ridges defining said notch therebetween.

16. The pre-set lock system of claim 15, wherein said at least first and second connector members comprise, respectively, axially mating male and female connector members, said male connector member including a centrally disposed protrusion having a passageway therein for axially receiving said bolt shaft, said detents being arranged on said centrally disposed protrusion so as to be adjacent said passageway.

17. The pre-set lock system of claim 16, wherein said centrally disposed protrusion is further defined by a pair of flexible finger-like projections arranged in diametrically-opposed fashion about said passageway, said detents extending from distal ends of said projections.

* * * * *